United States Patent [19]

Bolton

[11] 4,181,845

[45] Jan. 1, 1980

[54] APPARATUS FOR TEMPERING THE WELD BETWEEN A TOOL JOINT CONNECTOR AND A DRILL PIPE TUBE

[75] Inventor: Jimmie B. Bolton, Houston, Tex.

[73] Assignee: Smith International, Inc., Newport Beach, Calif.

[21] Appl. No.: 814,542

[22] Filed: Jul. 11, 1977

[51] Int. Cl.[2] ..... H05B 5/04

[52] U.S. Cl. ..... 219/8.5; 219/10.69; 219/10.77; 148/127; 266/87

[58] Field of Search ..... 219/6.5, 7.5, 8.5, 10.57, 219/10.67, 10.69, 10.73, 10.75, 10.77, 10.79, 9.5, 10.41, 10.43; 266/78, 87; 148/127, 128, 131, 133, 154

[56] References Cited

U.S. PATENT DOCUMENTS

| | | | |
|---|---|---|---|
| 1,981,631 | 11/1934 | Northrup | 219/10.77 |
| 2,395,937 | 3/1946 | Paalu | 219/10.75 UX |
| 2,417,678 | 3/1947 | Cox | 219/10.73 |
| 2,676,234 | 4/1954 | Lackner et al. | 219/10.77 |
| 2,959,660 | 11/1960 | Schmidt | 219/10.69 |
| 3,080,468 | 3/1963 | Wuczkowski | 219/10.75 |
| 3,587,268 | 6/1971 | Bricmont et al. | 219/10.77 |
| 3,614,366 | 10/1971 | Huchok | 219/10.77 |
| 3,755,010 | 8/1973 | Moliterno | 148/153 |
| 3,781,504 | 12/1973 | Harnden | 219/10.77 |
| 3,824,366 | 7/1974 | Garnier | 219/10.77 |
| 3,873,830 | 3/1975 | Forster | 148/128 |
| 3,933,534 | 1/1976 | Ettenreich | 148/154 |
| 3,997,374 | 12/1976 | Dill et al. | 148/127 |
| 4,001,054 | 1/1977 | Makepeace | 148/16.5 |
| 4,050,963 | 9/1977 | Kunioka et al. | 148/128 |

*Primary Examiner*—Bruce A. Reynolds

*Assistant Examiner*—Philip H. Leung

*Attorney, Agent, or Firm*—Murray Robinson; Ned L. Conley; David Alan Rose

[57] ABSTRACT

An alloy steel tool joint connector is friction welded to one end of a seamless steel drill pipe tube. The weld area cools in the air as the pipe moves to a first tempering station. The weld area is brittle and too hard to machine.

When the weld is below a temperature corresponding to 90% transformation from austenite to martensite, an infrared radiation responsive control viewing the weld causes an induction heating coil to be moved axially onto the end of the pipe. Energization of the coil reheats the weld area to a temperature below austenitizing but sufficient to temper the steel, and an infrared radiation responsive control viewing the pipe radially through a radial view passage in the coil deenergizes the induction heating coil and causes the coil to be withdrawn from the end of the pipe. The friction weld is then machined off inside and outside.

The pipe is then moved to a rehardening station at which the weld area is heated to austenitize the steel following which it is fluid quenched to reharden it.

The pipe is then moved to a second tempering station and its end is moved axially into an induction heating coil, whereupon the weld area is reheated. An infrared radiation responsive control viewing the weld obliquely through a slot in the coil's inner periphery deenergizes the coil when tempering temperature is reached. The pipe end is then withdrawn from the coil to cool in the air, such tempering toughening the weld area without unduly softening it.

2 Claims, 16 Drawing Figures

Fig. 2
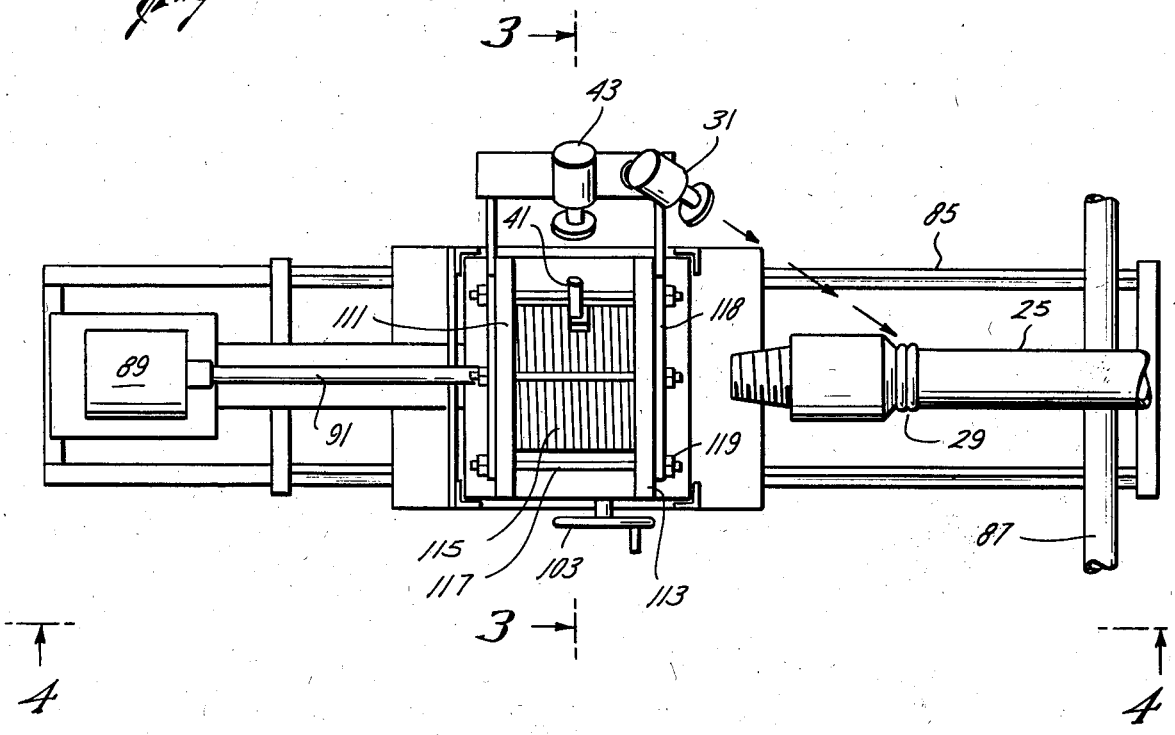
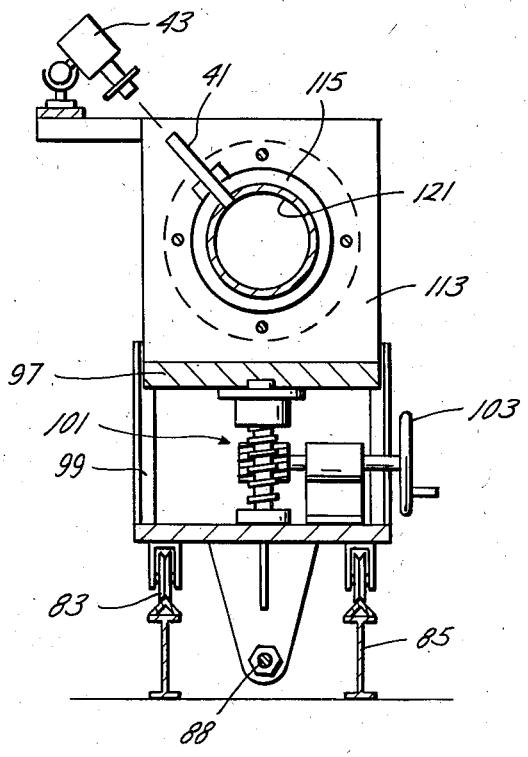
Fig. 3

Fig. 7
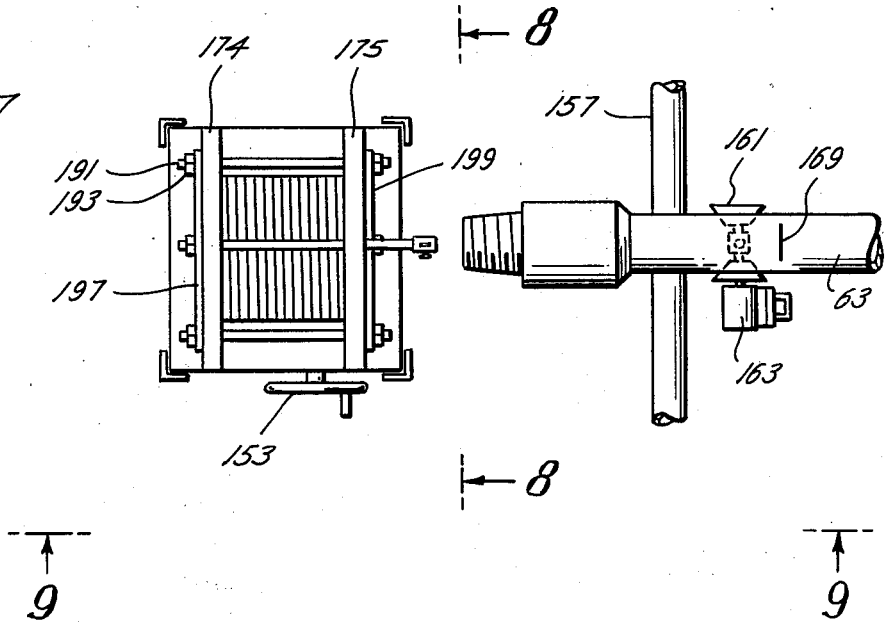
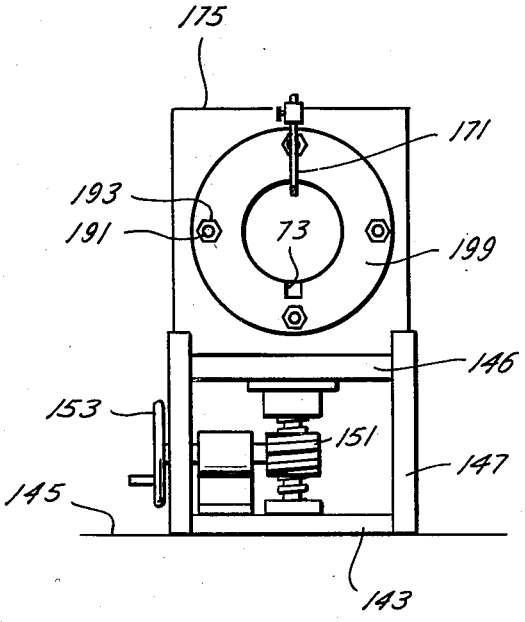
Fig. 8

APPARATUS FOR TEMPERING THE WELD BETWEEN A TOOL JOINT CONNECTOR AND A DRILL PIPE TUBE

This invention relates to the manufacture of drill pipe and more particularly to tempering of the weld area, after an alloy steel tool joint is welded to an end of a length of seamless steel tube, thereby to facilitate machining off the weld flash, and to tempering of the weld area after it has, by heating and quenching, been rehardened, thereby to toughen the weld zone, and to infrared radiation responsive control of the tempering process, thereby to speed and enhance uniformity of the temper, and to electric induction heating coils with view passages useful in such control.

It is known to attach alloy steel tool joint connectors to seamless steel tube by friction welding, to temper the weld area preparatory to machining off the flash, to reharden the weld area after machining off the flash, and to retemper the weld area. After the weld is made the weld area has been water cooled to room temperature. This insures that a nearly complete transition from austenite to martensite has occurred before the weld area is tempered by reheating.

The water cooling step is an added expense. Its purpose is to speed up the operation, for absent the water cooling it would take a long time for the weld area to reach room temperature. Actually, cooling to only 300° Fahrenheit would be sufficient, but that would require a temperature determination. Application of a thermocouple to the weld area for exact temperature measurements would be time consuming, and in view of the fact that the weld area and also the adjacent portion of the tube and joint are quite hot, application of a thermocouple would also be quite difficult and dangerous.

After the weld zone has been cooled, according to prior practice it has been reheated for a preset time. Because of other variables such as ambient air temperature, temperature of the water coolant for the induction coil and supply voltage to the induction coil, the final temperature of the weld area after leaving the induction coil is uncertain. The use of a thermocouple to determine precise temperature would be even more difficult than in the previous cooling stage since the weld area is inside the induction coil where accessibility is minimal and conductive metal parts would be inductively heated and other parts would be heated from the adjacent pipe.

After weld flash has been removed and the weld area rehardened, the weld area has been retempered by reheating for a preset time in an electric induction heating coil. Precise temperature control may not be achieved for the same reasons and because of the same problems as in the first tempering operation. It may be added that in both cases although the fluid quench at the preceding station insures that the weld area is below the 90% transformation to martensite temperature, the precise initial temperature is still uncertain so that reheating for any preset time will result in uncertain tempering temperature.

It is well known that accurate control of temperature is an important factor in the tempering of steel. With respect to tempering or drawing steel it has been said in Johnson's "Materials of Construction", Seventh Edition, published 1930 by John Wiley & Sons, Inc., p. 641, 642, section 707, "Methods of Tempering or Drawing Steels":

> "In all heat treating operations, the aim is to secure a minimum size of grain * * * The drawing temperature is most accurately indicated by a pyrometer, but in tool dressing, color methods give a simple and reasonably accurate control."

Despite the early recognition of the desirability of accurate temperature control in tempering steel in general, such apparently has not been the practice in connection with the tempering of drill pipe welds, either because of a lack of appreciation of the need or an inability to effect the result, and instead indirect methods of temperature determination have been used, e.g. timed cooling and heating in specified surroundings.

SUMMARY OF THE INVENTION

According to the invention pipe coming from the friction welding station where a tool joint has been attached to the tube, is positioned with the weld area in the focus of an infrared radiation detector. The detector views the weld area and when the weld area has cooled to the 90% martensite transformation point, the detector generates a signal actuating a hydraulic cylinder to move an electric induction heating coil over the end of the pipe around the weld. With the coil in position, the electric power is turned on, e.g. by an operator, and the weld is reheated to a desired temperature below the transition range to temper the weld hardened steel. The coil is provided with a radial window between its turns. Another infrared radiation detector is positioned with its focus on the weld area as seen through the window, the first detector having moved away, both detectors being mounted on the coil frame. When the weld zone reaches the desired tempering temperature as viewed by the infrared detector, the latter generates a signal effective to turn off the electric power to the coil and withdraw the coil from the end of the pipe.

After the weld flash has been removed from the weld area, both inside and outside the pipe, by reaming the inside and turning the outside, the weld area is rehardened by reheating to austenitizing temperature and quenching. The pipe end is then moved axially into another electric induction heating coil and the weld area is reheated to a desired temperature below the transition range to temper the weld area. The weld area is viewed obliquely through a slot in the inner periphery of the induction coil guard tube by an infrared radiation responsive detector. When the weld area reaches the desired temperature, a signal is generated by the detector to effect shut off of the electric power supplied to the induction heating coil. The weld area is then allowed to cool in quiet air.

The invention eliminates the water cooling station heretofore used between the friction welder and the first tempering station. It provides more accurate control of the tempering temperature at both the first and second tempering stations. It also makes the apparatus independent of pipe size since actual temperature is used to control termination of heating. In contrast, if time is relied upon to control cut off of heating the time must be ascertained and set for each size of pipe.

According to a modification of the invention, an optical fibre, e.g. a quartz rod, is used to transmit infrared radiation from the inner periphery of the induction coil to the focus of the infrared detector.

BRIEF DESCRIPTION OF THE DRAWINGS:

For a detailed description of the method and apparatus of the invention, reference will now be made to the accompanying drawings wherein:

FIGS. 2, 3, 4 and 5 are simplified or schematic top, end and two side views (one with pipe in coil and one with pipe out of coil) of a movable electric induction heating coil with associated infrared detectors, used at the first tempering station in accordance with the invention;

FIGS. 7, 8, 9 and 10 are simplified or schematic top, end and two side views of a fixed electric induction heating coil with associated infrared detector, used at the second tempering station, in accordance with the invention;

Figure 1:
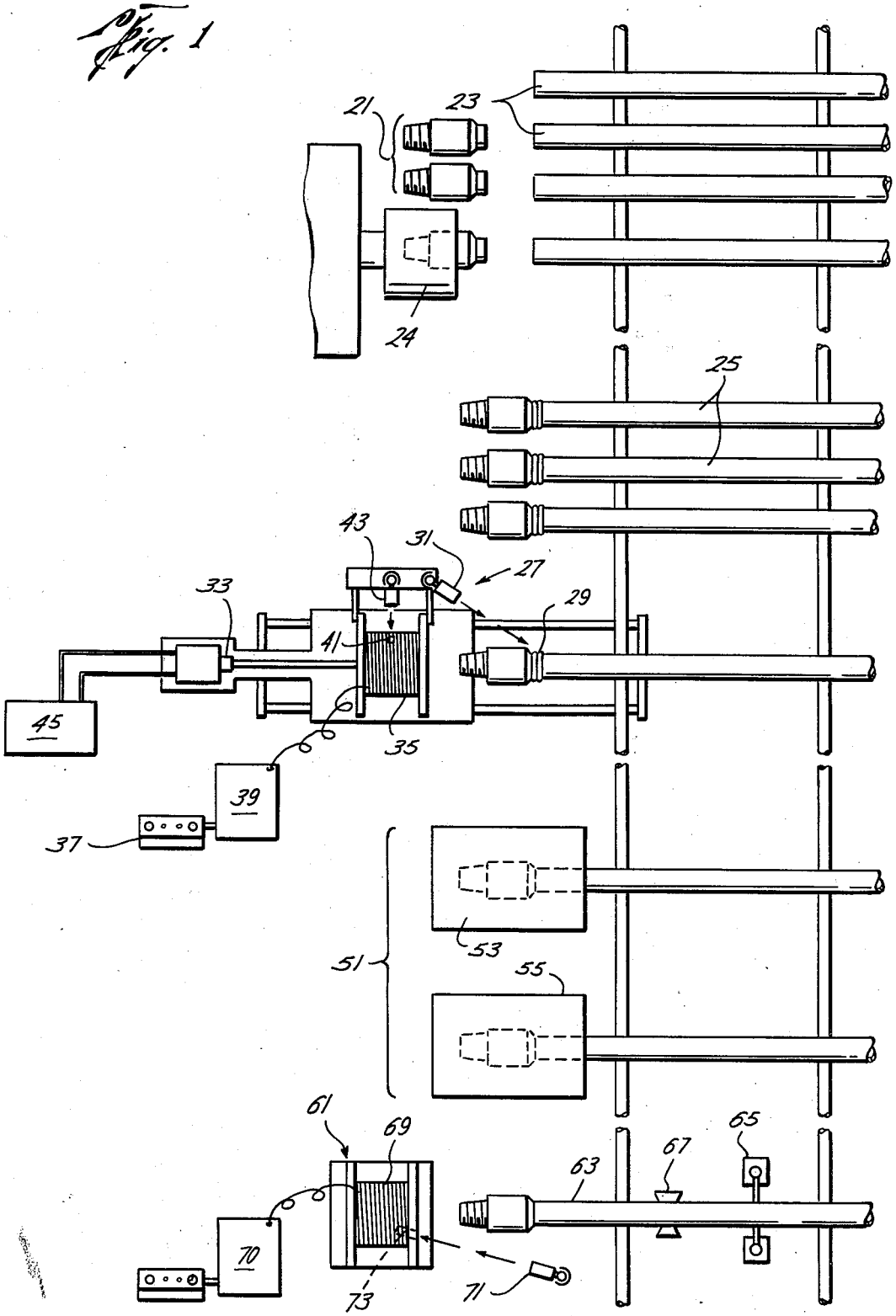
FIG. 1 is a diagrammatic plan view of apparatus in accordance with the invention.

DESCRIPTION OF THE PREFERRED EMBODIMENT:

Referring now to FIG. 1 there is shown a plant layout for assembling tool joint connectors 21 to drill pipe tubes 23. A tube and a connector are brought to a friction welding apparatus 24. After a connector and tube have been welded together to form pipe 25, the pipe is moved to a first tempering station 27. The weld area 29 is viewed by the eye 31 of an infrared radiation responsive control means. When the weld area has cooled, e.g. to 300° Fahrenheit, the control means generates an electric signal causing hydraulic motor 33 to move electric induction heating coil 35 axially over the end of the pipe about the weld area. An operator at control panel 37 manually causes the coil to be connected to a source of electric power 39 to heat the weld area. The weld area is viewed through infrared radiation transmitting window 41 in the coil by eye 43 of another infrared radiation responsive control means. When the temperature reaches 1250° Fahrenheit, the control means causes the coil to be disconnected from the electric power supply 39 and to be moved axially away from the pipe back to its original position. Such motion is effected by hydraulic motor 33 which is supplied with pressurized fluid from hydraulic power supply 45.

After the weld area has been tempered as above described, the pipe is allowed to cool in quiet air. The weld flash is then machined off, e.g. by turning the exterior of the weld area and reaming its interior.

The pipe is then transferred to hardening station 51 whereat the weld area is heated to a temperature just sufficient to cause complete austenitizing, e.g. 1800° Fahrenheit, in electric induction heating coil apparatus 53. Thereafter, it is cooled quickly by fluid flow quench apparatus 55. Any suitable known quenching apparatus may be employed to effect desired hardening. Such quenching will lower the temperature of the weld area below a temperature corresponding to M-90, e.g. 375° F. to 550° F.

Thereafter the pipe is moved to a second tempering station 61. At this station the machined and hardened pipe 63 is elevated by hydraulic jacks 65 and driven axially by live rolls 67 to place the weld area of the pipe in the electric induction heating coil 69. The coil is activated manually to cause the weld area to be heated to a desired tempering temperature. The weld area is viewed by an infrared eye 71 looking obliquely through an end of the coil and a slot at the inner periphery thereof forming a window 73. The eye is part of an infrared radiation responsive control means. When the temperature of the weld area reaches, e.g. 1250° Fahrenheit, the control means automatically disconnects the coil 69 from the electric power supply 70. The pipe is then allowed to cool.

The pipe may then be run through the same set of operations again at the same or a similar site to apply a tool joint connector to the other end of the tube.

The temperatures specified in the foregoing are suitable for tool joints made of AISI 4137 chrome molybdenum steel and an API grade E tube. The effect of such treatment on such steel may be inferred by extrapolation between the transformation diagrams for 4130 and 4140chromium-molybdenum steels appearing at pgs. 152 and 153 of the "Atlas of Isothermal Transformation and Cooling Transformation Diagrams" published by the American Society For Metals. For other materials other temperatures may be appropriate to effect full austenitizing in the hardening stage and desired tempering following welding and following hardening. Also, the precise temperatures given for the specified steels are only examples and may be varied, e.g. cooling may be below 375°-550° F. and tempering may be in the range of 1000° F. to 1300° F.

Figure 4:
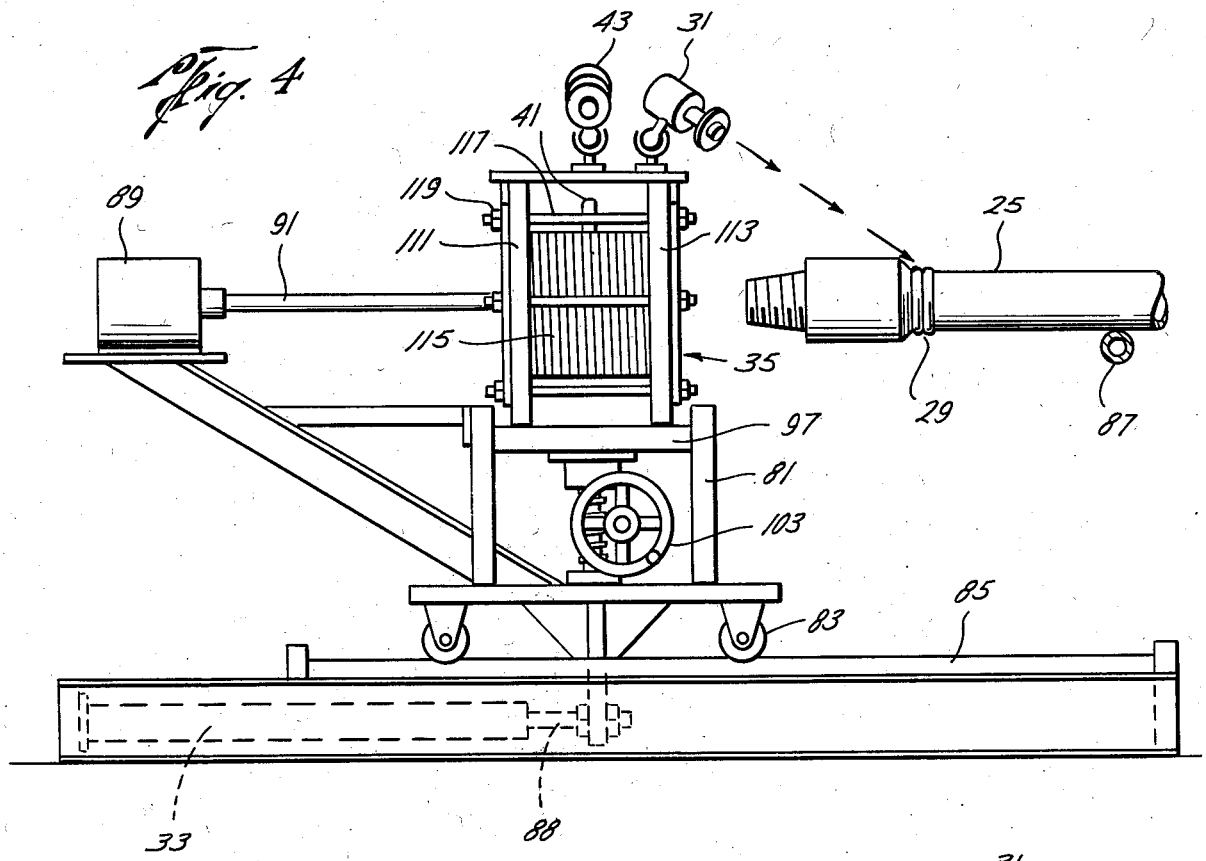
Figure 5:
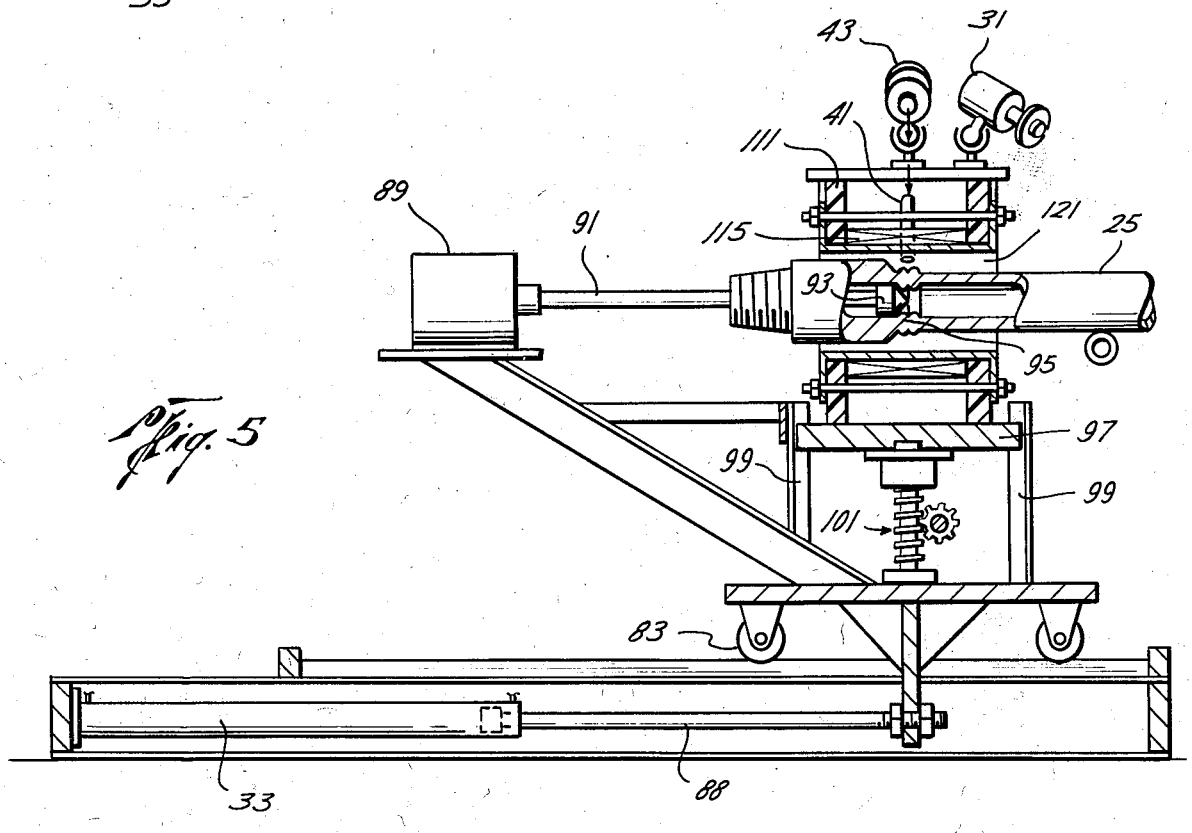

Referring now to FIGS. 2, 3, 4 and 5, there is shown induction heating coil 35 and associated apparatus at the first tempering station 27. Coil 35 is mounted on a carriage 81 supported by wheels 83 to move back and forth on rails 85. Pipe 25 is supported on rack 87 with its axis in alignment with that of the coil. The coil is moved between an inactive position shown in FIG. 4 to an active position shown in FIG. 5 by hydraulic cylinder means 33 whose piston rod 88 is connected to carriage 81. A limit switch 89 fixedly mounted on carriage 81 is actuated by a stinger 91 when, as shown in FIG. 5, a head 93 on the end of the stinger engages an internal shoulder in the pipe. Such shoulder may be the internal weld flash 95, as shown. Tripping of the limit switch deactivates motor 33 to bring coil 35 to rest centered about the weld area. To insure that the coil and stringer are coaxial with the pipe 25, which from time to time may vary in outer diameter, carriage 81 includes a platform 97 which is movable up and down between guide rails 99 by means of a circular rack and pinion gear 101 actuated by hand wheel 103. A suitable reduction gear is provided (not shown) between the hand wheel and the pinion shaft to obtain the desired mechanical advantage to prevent downward movement of the platform after positioning with the hand wheel.

As shown in FIG. 4, when coil 35 is in retracted or inactive position, infrared eye 31 is focused on weld area 29. When coil 35 is in advanced or heating position, as shown in FIG. 5, infrared eye 43 is focused on weld area 29 through window 41.

Coil 35 includes square end plates 111, 113 bearing against the ends of conductive helix 115 and held together by through bolt means including bolts 117 and nuts 119. Plates 111, 113 are centrally apertured to receive the end of pipe 25. A guard tube 121 made of non-magnetic material lines helix 115. Tube 121 is either non-conductive or split to reduce the amplitude of eddy currents therein.

Figure 6B:
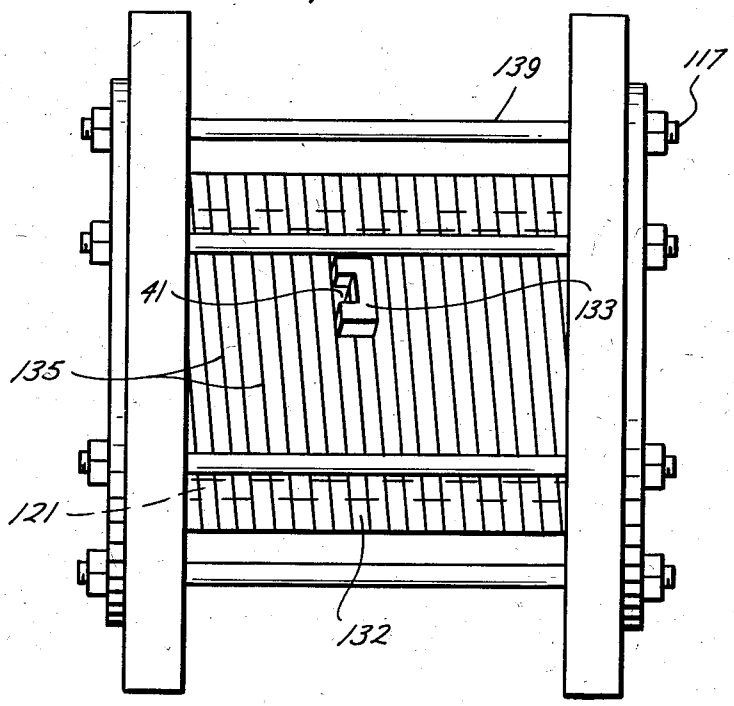
FIGS. 6A, 6B and 6C are drawings illustrating the induction heating coil with radial window used at the first tempering station.
Figure 6C:
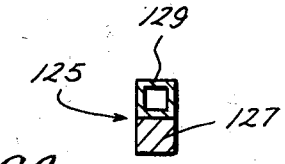
Figure 6A:
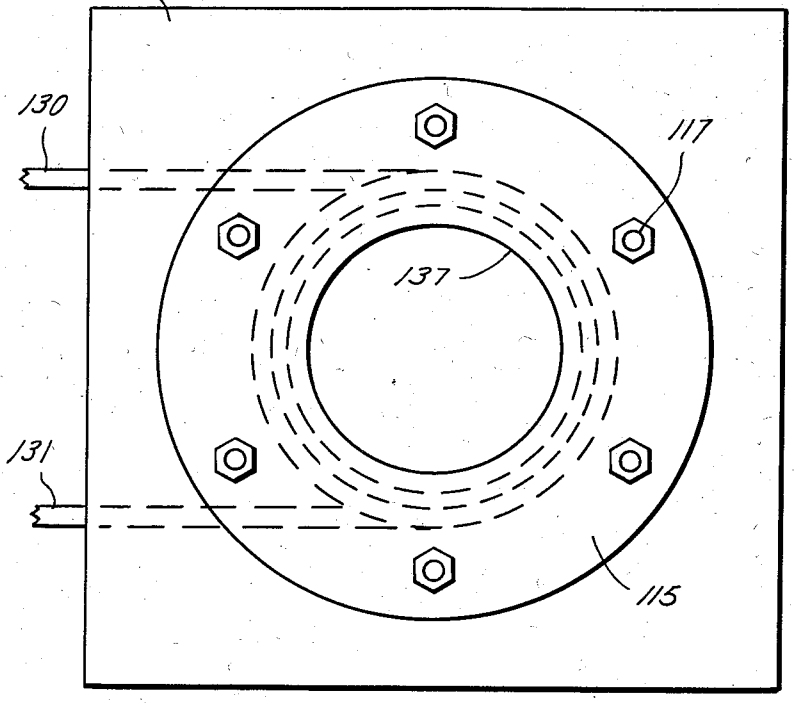

Referring now to FIGS. 6A, 6B and 6C, further details of coil 35 are shown. As seen in FIG. 6C, the conductive helix 115 is formed of a copper conductor 125 of rectangular cross section having a square solid portion 127 and a rectangular tubular portion 129 through which flows cooling water or other coolant when the coil is carrying electric current. FIG. 6A shows that both water and electricity flow in and out of helix 115 via the end connections 130, 131.

FIG. 6B best illustrates the infrared radiation window 41 through which a weld area inside the coil may be viewed from outside of the coil. To create the window one turn 132 of the conductor 125 is interrupted and connected to an outside detour conductor 133 of U shape, which carries both electricity and water between the interrupted portions of turn 132.

As shown in FIG. 6B there are layers of Micarta insulation 135 between each turn of conductor 125 forming helix 115. This, in conjunction with guard tube 121 which lines the helix, prevents the electricity in the helix from short circuiting.

Referring once more to FIG. 6A, end plate 111 (and similarly end plate 113) is centrally apertured at 137 in register with the inner periphery of liner 121. Plates 111 and 113 are made of material that is both thermally and electically non-conductive, e.g. Micarta. Also, as shown at 139 in FIG. 6B, through bolts 117 are covered on their outer peripheries with Micarta insulation.

Referring now to FIGS. 7, 8, 9 and 10, there is shown induction heating coil 69 and associated apparatus at the second tempering station. Coil 69 is mounted on support means 141 which includes a frame 143 affixed to factory floor 145. Support means 141 further includes a table 146 which can move up and down between guide rails 147. The table is moved up and down by a rack and pinion 149, 151 driven through a suitable gear box (not shown) by hand wheel 153. By this means coil 69 can be positioned so that its axis is at the same level and hence coaxial with a pipe 63 at the second tempering station.

Figure 9:
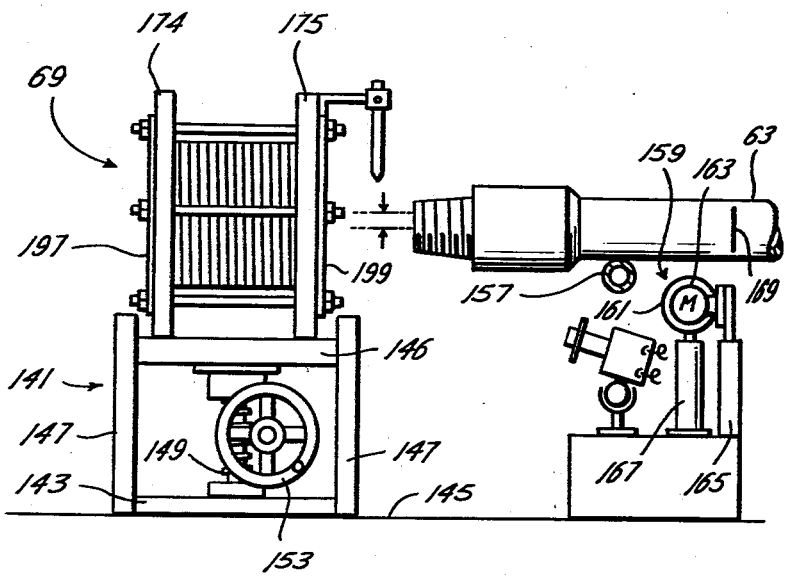
Figure 10:
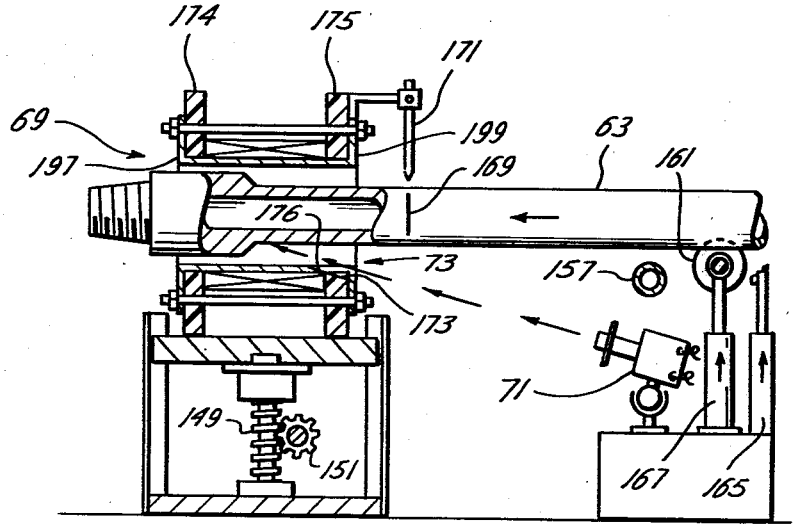

FIGS. 9 and 10 show pipe 63 positioned on or above rack 157. To shift the pipe axially between the withdrawn or inactive position of FIG. 9 and the heating or extended position of FIG. 10, there is provided at each end of pipe 63 a drive means 159 comprising a live roll 161 driven by a motor 163 mounted on telescopic stand 165. The drive means is raised and lowered between the lower or inactive position of FIG. 9 and the upper or active position of FIG. 10 by hydraulic cylinder motor means 167.

Before the weld flash is removed from the pipe, a circular line 169 is scribed on the pipe a preset distance from the weld area. When pipe 63 is elevated and moved axially into coil 69 by drive means 159, the operator turns off the power to electric motor 163 when line 169 is aligned with marker pointer 171 affixed to the coil. At that position the weld area of the pipe is centrally positioned within coil 69 for heating of the weld area.

Coil 69 is similar in construction to coil 35 of the first tempering station. Instead of a radial infrared viewing window, coil 69 is provided with an end window 73 formed by a slot 173 in one end plate 175 in register with a slot 176 in the coil's liner. By means of this window infrared eye 71 of an infrared radiation responsive control means views the weld area of pipe 63, such eye being focused on the weld area.

Figure 11A:
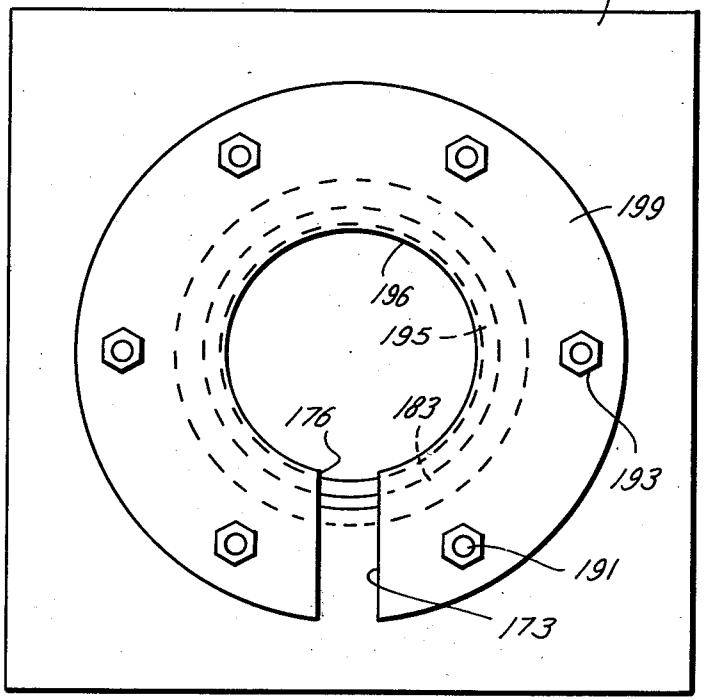
FIGS. 11A and 11B are drawings showing the induction heating coil with axial view slot used at the second tempering station.
Figure 11B:
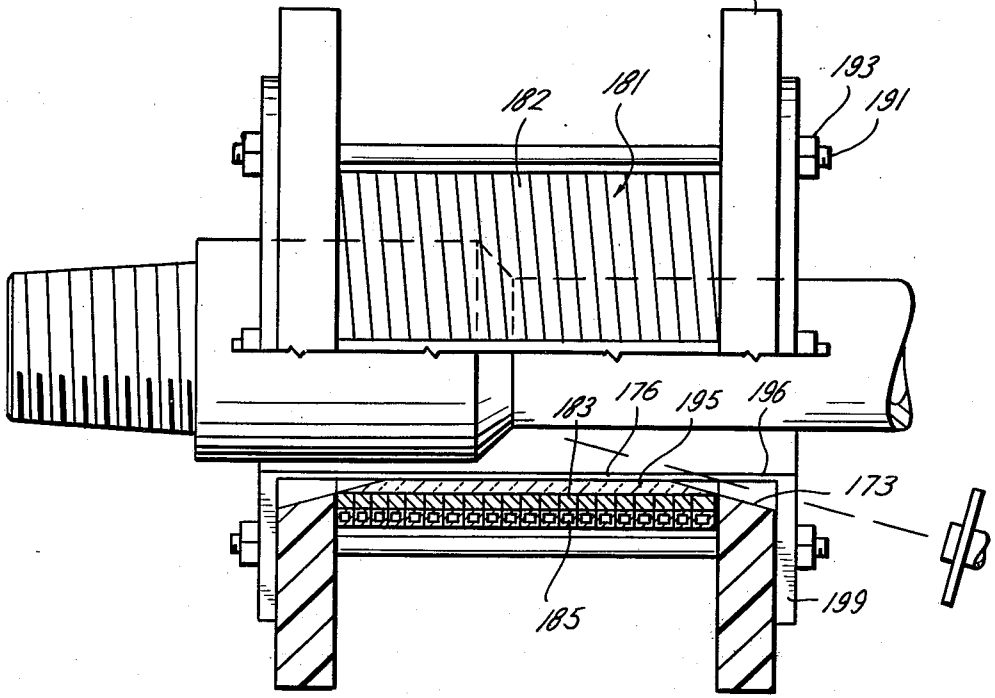

Referring now to FIGS. 11A and 11B there are shown further details of coil 69. The coil includes a conductive helix 181 made of a copper conductor 182 of rectangular cross section including a solid square portion 183 and a tubular square portion 185. Centrally apertured fibre board end plates 174,175 (see also FIGS. 9 and 10) are held together by insulated through bolt means including bolts 191 and nuts 193. Suitable insulation, not shown, is disposed between the turns of the helix, i.e. around the perimeter of conductor 182. An insulating tube 195 and a steel guard tube 196 line the inner periphery of the helix. Insulating washers 197, 199 (see also FIGS. 9 and 10) abut the ends of the guard tube and overlap plates 174, 175, respectively. Washer 199 is also slotted to form part of window 73.

Figure 12A:
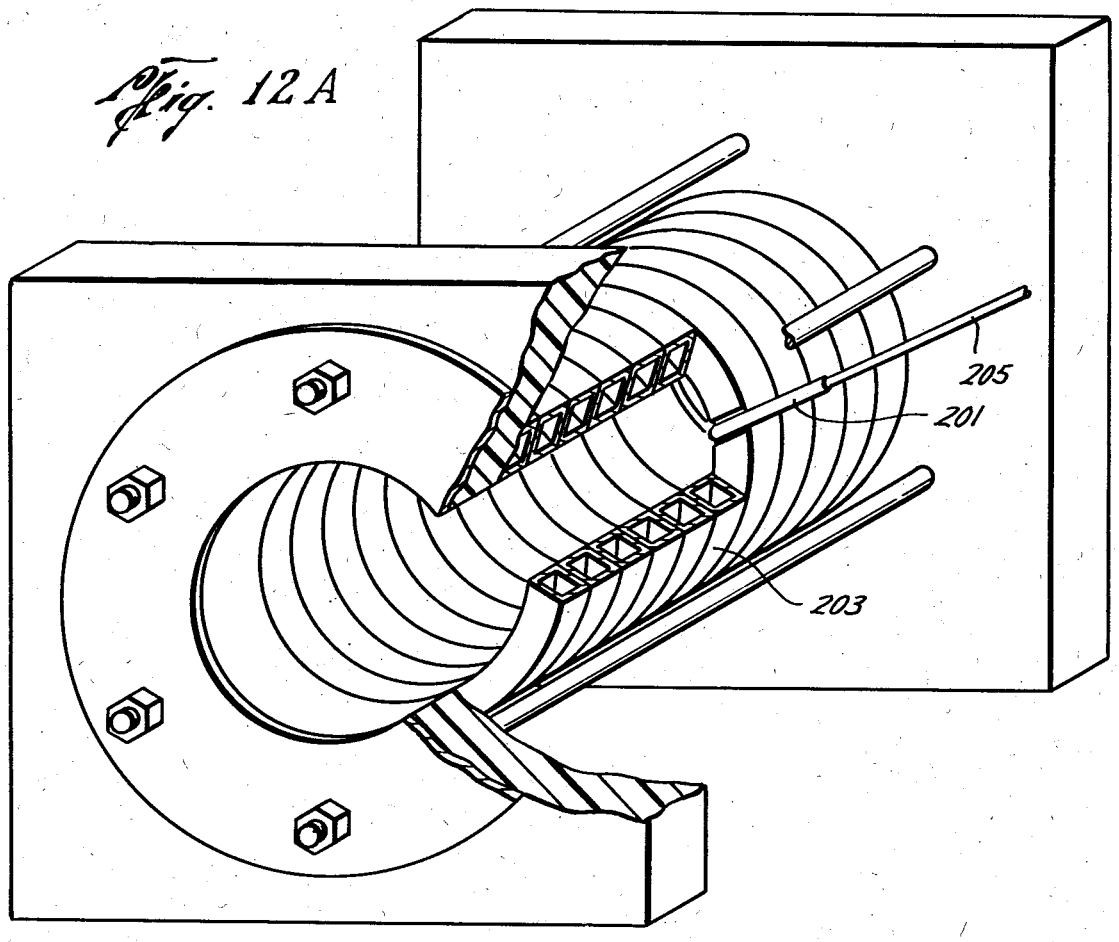
FIGS. 12A and 12B are drawings showing a modification employing an optical fibre.
Figure 12B:
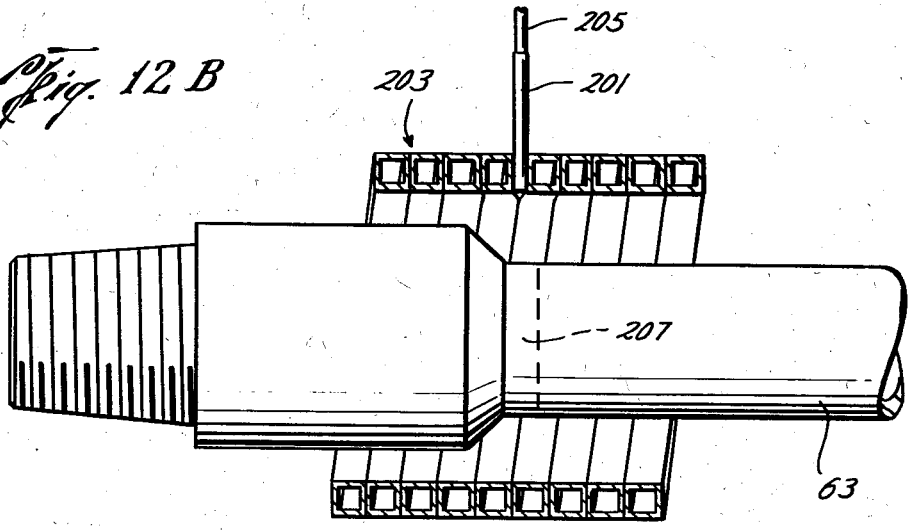

Referring now to FIGS. 12A and 12B there are shown details of a modified form of induction coil similar to those previously described, for example, coil 69. Instead of an oblique window through the end of the coil, as in coil 69, a radial window is provided formed by an infrared radiation transmitting means in the form of an optical fibre 201 inserted radially between two adjacent turns of the helix or solenoid 203. An extension 205 of fibre 201, which may be flexible, is continued to a desired location to transmit infrared radiation from weld area 207 to an infrared detector means, not shown.

The induction heating coil 53 used at the hardening station 51 (FIG. 1) may be of similar construction to that employed at the tempering stations. At any of these stations either the pipe or the coil or both may be moved axially in and out to position the coil and weld area for heating or not. A quenching arrangement suitable for quench means 55 (FIG. 1) is disclosed in U.S. Pat. No. 3,997,374. However other quenching means, e.g., as disclosed in the prior art cited in the patent may also be employed. See also pgs. 2760 and 2761 of the 1974/75 edition of the Composite Catalog of Oil Field Equipment and Service.

For details of infrared radiation detection and control means, reference may be made to an article entitled "Industrial Radiation Pyrometers" by G. F. Warneke, of Ircon, Inc., appearing in Instrumentation Technology, and to a brochure published by Ircon entitled "Introduction To Radiation Thermometry". Also, an Ircon Catalog MD-107 describes their "Modline" system for measurement and control of temperatures. "Modline" series 7000 thermometers, used in the apparatus herein described, are further described in an Operations Manaul published by Ircon, Inc.

The necessary electric and hydraulic circuits for connecting the infrared eyes to the switches controlling motion and energization of the induction heating coils are shown in drawings number C-29533, C-29974 and D-30086 of the assignee of the present application. Prints of these drawings accompany this application for reference in case a question as to construction and operation arises. For like reason, there are also furnished with this application a number of photographs of the apparatus described.

While preferred embodiments of the invention have been shown and described, modifications can be made by one skilled in the art without departing from the spirit of the invention.

A further possible modification of the invention would be to employ at the second tempering station a two eye apparatus similar to that at the first tempering station, or to add a second fixed eye at the second tempering station. In either case the second eye would view the weld area of the pipe coming from the hardening station 51 to make sure that the quenched weld area has not overcooled, e.g. below 200° F. Some steel may crack if overcooled prior to tempering. If the eye indicates that a dangerously low temperature has been reached, an alarm would be sounded or the pipe automatically removed from the treating line.

A further modification would be at the first and/or second tempering station to use a single eye looking through the coil. The relative axial position of the pipe and coil would be changed (by moving the coil and/or pipe) to place the weld area within the coil but the eye would not turn the coil on (or allow it to be turned on) until this correct cool temperature of the weld area was reached. Thereafter the eye would turn off the coil and/or restore the original non-heating relative position of coil and pipe when the desired temperature of the weld area was reached.

Although the treatment at both the post welding and post hardening heating stations is herein called tempering, it will be understood that this is a matter of lexicography, e.g. some would call the heating at the first tempering station a stress relief treatment or operation.

I claim:

1. Apparatus for tempering the weld area between a tool joint ocnnector and one end of a drill pipe tube, said apparatus comprising:

an electric induction heating coil into which said weld area may be placed to be heated, means to support said drill pipe tube in an inital position with the axis of the tube aligned with the axis of the coil and with the weld area outside of the coil, motor means for changing the relative axial position of said tube and coil to a heating position in which the coil is about said weld area and for restoring said initial relative axial position of said tube and coil, a first infrared radiation responsive detector means for generating a first electric signal in response to infrared radiation of a specified temperature, said first detector means including an infrared optical system focused to view said weld area of said drill pipe tube when in said initial position, means responsive to said first signal for actuating said motor means to cause said tube and coil to be placed in said heating position, said coil having a path for infrared viewing of said weld area from outside of the coil while said coil is about the weld area, second infrared radiation responsive detector means for generating a second electric signal in response to infrared radiation of a certain temperature, said second detector means including a second infrared optical system focused through said path on a surface radially inward of the inner periphery of said coil where said weld area may be positioned, and means responsive to said second signal for actuating said motor means to cause said tube and coil to be placed in said initial relative axial position, both of said detection means optical systems being mounted to be stationary relative to said coil, said motor means moving said coil axially to and from said weld area without motion of the tube and connector, whereby said detector means optical systems are alternately focused upon said weld area.

2. Apparatus according to claim 1, including an electric circuit connectable to a source of electric power for energizing said coil, manual means for closing said circuit after said coil has been moved to heating position, and means responsive to said signal from said second detection means for interrupting said circuit.

* * * * *

UNITED STATES PATENT AND TRADEMARK OFFICE

CERTIFICATE OF CORRECTION

PATENT NO. : 4,181,845

DATED : Jan. 1 , 1980

INVENTOR(S) : Jimmie B. Bolton

It is certified that error appears in the above—identified patent and that said Letters Patent is hereby corrected as shown below:

Column 1, line 21, after "made" insert a -,-.
Column 1, line 46, after "stage" insert a -,-.
Column 2, line 17, after "invention" insert a -,-.
Column 2, line 63, after "heating" insert a -,-.
Column 4, line 25, after "materials" insert a -,-.
Column 4, line 48, change "stringer" to -stinger-.
Column 5, line 28, change "electically" to -electrically-.
Column 7, line 28, change "ocnnector" to -connector-.
Column 7, line 33, change "inital" to -initial-.

Signed and Sealed this

*Ninth* Day of *September 1980*

[SEAL]

*Attest:*

SIDNEY A. DIAMOND

*Attesting Officer*

*Commissioner of Patents and Trademarks*